US010739092B2

(12) United States Patent
Gritskevitch et al.

(10) Patent No.: US 10,739,092 B2
(45) Date of Patent: Aug. 11, 2020

(54) DEVICE FOR EJECTING CARTRIDGES AND/OR LINKS FROM A CHAIN OR AMMUNITION STRIP CONNECTED TO A MAIN AND/OR SECONDARY WEAPON

(71) Applicant: CMI DEFENCE S.A., Loncin (BE)

(72) Inventors: Innokenty Gritskevitch, Liege (BE); Anthony Colomine, Ixelles (BE)

(73) Assignee: CMI DEFENCE S.A., Loncin (BE)

( * ) Notice: Subject to any disclaimer, the term of this patent is extended or adjusted under 35 U.S.C. 154(b) by 0 days.

(21) Appl. No.: 16/329,767

(22) PCT Filed: Sep. 14, 2017

(86) PCT No.: PCT/EP2017/073204
§ 371 (c)(1),
(2) Date: Mar. 1, 2019

(87) PCT Pub. No.: WO2018/068984
PCT Pub. Date: Apr. 19, 2018

(65) Prior Publication Data

US 2019/0242664 A1 Aug. 8, 2019

(30) Foreign Application Priority Data

Oct. 10, 2016 (BE) ..... 2016/5757

(51) Int. Cl.
*F41A 9/60* (2006.01)
*F41A 15/00* (2006.01)

(52) U.S. Cl.
CPC ..... *F41A 9/60* (2013.01); *F41A 15/00* (2013.01)

(58) Field of Classification Search
CPC ..... F41A 9/60; F41A 15/00
(Continued)

(56) References Cited

U.S. PATENT DOCUMENTS 4,038,904 A * 8/1977 Rocha ..... F41A 9/31 89/33.03
4,601,230 A * 7/1986 LeBlanc ..... F41A 19/10 89/1.2

(Continued)

FOREIGN PATENT DOCUMENTS

EP 0149704 A2 7/1985
EP 2156131 A1 2/2010

(Continued)

*Primary Examiner* — Samir Abdosh
(74) *Attorney, Agent, or Firm* — Leydig, Voit & Mayer, Ltd.

(57) ABSTRACT

A device for ejecting shells and/or connectors from at least one chain or strip of ammunition associated with a primary and/or secondary weapon, the device being mounted in an armored vehicle turret, includes: a plurality of geometrically and mechanically defined structural elements, for guiding, after shooting the ammunition, a movement of the shells and/or connectors from an inside toward an outside of the turret, along a determined path; and a vibration device for vibrating at least part of the structural elements to favor the movement of the shells and/or connectors. The structural elements include at least one chute. The vibration device includes a motor placed in any location of the chute. The motor includes an unbalancing mass. The motor is actuatable only during shooting.

13 Claims, 4 Drawing Sheets

(58) Field of Classification Search
USPC ..... 42/25
See application file for complete search history.

(56) References Cited

U.S. PATENT DOCUMENTS

| | | | | |
|---|---|---|---|---|
| 6,176,169 | B1 * | 1/2001 | Rostocil | B64D 7/00 42/25 |
| 8,434,397 | B1 * | 5/2013 | Deckard | B64D 7/06 89/37.13 |
| 8,607,683 | B1 * | 12/2013 | Burgermeister | F41A 9/31 89/33.16 |
| 8,850,950 | B2 * | 10/2014 | Deckard | B64D 7/06 89/136 |
| 2010/0319521 | A1 | 12/2010 | Dick et al. | |
| 2014/0060309 | A1 * | 3/2014 | Deckard | B64D 7/06 89/136 |

FOREIGN PATENT DOCUMENTS

| | | | |
|---|---|---|---|
| FR | 804422 | A | 10/1936 |
| FR | 2977018 | A1 | 12/2012 |
| GB | 466310 | A | 5/1937 |
| WO | WO 2008140514 | A1 | 11/2008 |

* cited by examiner

DEVICE FOR EJECTING CARTRIDGES AND/OR LINKS FROM A CHAIN OR AMMUNITION STRIP CONNECTED TO A MAIN AND/OR SECONDARY WEAPON

CROSS-REFERENCE TO PRIOR APPLICATIONS

This application is a U.S. National Phase application under 35 U.S.C. § 371 of International Application No. PCT/EP2017/073204, filed on Sep. 14, 2017, and claims benefit to Belgian Patent Application No. BE 2016/5757, filed on Oct. 10, 2016. The International Application was published in French on Apr. 19, 2018 as WO 2018/068984 under PCT Article 21(2).

FIELD

The technological field of the invention relates to the ejection of shells and/or connectors from at least one (or combination of) chain(s) or strip(s) of ammunition characterized by a specific caliber, i.e., that going from the small to medium caliber, the small caliber being associated with a secondary weapon (called "machine-gun" or "coax"), while the medium caliber relates to a primary weapon (called "barrel"). The ejection is generally done after shooting from the inside toward the outside of a turret mounted on any armored vehicle, through an entire series of structures having specific geometric and mechanical characteristics.

BACKGROUND

The sequence of technical operations relative to the ejection of small- and/or medium-caliber ammunition residues may be generalized to the combination of two actions: i) recovering any material (stones, plants, etc.) falling under the effect of gravity into a closed circular structure, such as a pipe, and ii) transporting this material on a moving surface, such as a belt, provided with a vibrating device situated below the latter in order to modify some or all of the environmental conditions of the material.

Within a turret mounted on any armored vehicle, after conveying an ammunition chain or strip through one (or several) supply channel(s) toward the primary weapon (barrel) and/or secondary weapon (machine-gun or coax), where the ammunition either has a small caliber varying between 5.56 mm and 15 mm, or a medium caliber ranging from 20 mm to 50 mm, and after shooting said ammunition, the ejection of the shells and/or connectors making up the latter to date has never been a priority in the state of the art, either technically (mechanical, electrical, etc. parameters), or as relates to ergonomics and safety.

Thus, after shooting medium-caliber ammunition from an ammunition chain or strip at the primary weapon, the shells are ejected through an orifice situated near the barrel at the height of the turret mask. In other words, it is evacuated outside the turret in the forward direction "practically" parallel to the axis of said barrel, while the connectors are collected inside the turret, and more particularly within the basket, following a "random" path between the various internal modules such as the HMI (Human Machine Interface), the wiring systems, etc. In some scenarios, the ejection is sideways or downward, like what is described for a "coax".

Regarding the small-caliber ammunition associated with the secondary weapon, both for the shells and the connectors from the ammunition chain or strip, the recovery of these two units, also generally called residues, after shooting follows the same approach as that previously described for the connectors of the medium-caliber ammunition chain or strip of the barrel.

Without a system for recovering the shells and/or connectors of an ammunition chain or strip characterized by the two aforementioned calibers, it is essential to develop an effective and safe approach accounting for the bulk, electromechanical parameters and contractual constraints, while economically optimizing the turrets previously developed. In other words, for each project, old and new, it is necessary to rethink and optimize the architectural concept in the mask of the turret.

Regarding the i) conceptual (electronic and mechanical engineering), ii) safety, and iii) economic perspectives, the approach described above is not acceptable, or profitable for the builder. Furthermore, the user's requirements are relatively drastic at all levels, which is why a new approach is necessary to remain competitive and innovative.

In the prior art, the proposed solutions are based on the fact that only the shells from the medium-caliber ammunition chain or strip intended for the primary weapon are ejected after shooting, either outside the turret through a specific orifice arranged near said primary weapon, or into a specific collector provided inside the latter. The connectors of the medium-caliber ammunition chain or strip, as well as the residues associated with the small-caliber ammunition intended for the secondary weapon, travel, after shooting, either through one (or two) ejection channel(s) (barrel), or one (or two) evacuation channel(s) (coax), such that, upon leaving the latter, they naturally fall under the effect of gravity inside the turret at the basket, but randomly regarding the reception location.

In addition to the approach described above, a whole series of devices for storing shells and/or connectors is known that have been developed on portable weapons (pistol, rifle, machine-gun, etc.), but without allowing their ejection. In other words, these mechanisms are not transposable to the device developed in the present invention within a turret mounted on any armored vehicle.

In document FR 2,977,018, the invention proposes a device for recovering connectors ejected by a weapon shooting ammunition connected by connectors. This connector recovery device includes a moving corridor conveying connectors that is secured by a first end to a window for ejecting connectors from the weapon. The moving corridor slides at a second end relative to a first end of a fixed corridor conveying connectors, the fixed corridor being secured by its second end to an ammunition box and emerging therein. The fixed corridor also includes a means for propelling connectors favoring the individual progression of each connector in the fixed corridor, the recovery device also including, at the moving corridor and the fixed corridor, a means for guiding the connectors. The propulsion means includes at least one connector propeller that is rotating and placed laterally with respect to the fixed corridor, and the rotation axis of which is perpendicular to the direction of advance of the connectors in the fixed corridor and parallel to the longitudinal axis of the connectors. In one preferred embodiment, the connector propeller includes a cylindrical brush with radial bristles. The guide means includes at least i) a first guide rail secured to the moving corridor able to correspond with the first notch of each connector and thus guiding the connector transversely to the first rail, ii) a second guide rail secured to the fixed corridor able to correspond with the first notch of each connector and guiding the connector transversely to the second rail, and iii)

an intermediate rail secured to the fixed corridor and able to correspond with a second notch of each connector guiding the connector transversely to the intermediate rail, when the connector goes from the moving corridor to the fixed corridor. The intermediate rail of the fixed corridor and the first (second, respectively) guide rail of the moving corridor (fixed corridor, respectively) are parallel and partially overlap without contact. Due to the recovery of the connectors, the ammunition box includes a moving partition made from a flexible material separating the connectors from the ammunition, which makes it possible not to increase the volume of the ammunition box.

In document EP 2,156,131, the invention relates to the side ejection belt for ejecting the empty connectors through a central receiver for a machine gun. This ejection on the side of the machine gun allows the barrel to interact with a center of gravity directly below the weapon to improve the general balance with this appropriate center of gravity and allows an ammunition box to be placed below the weapon. One aim resulting from these aspects is not to add substantial weight, mass or equipment to the machine gun. In one preferred embodiment, a machine gun with side strip loading i) ejects the used shells downward from an ejector below the barrel using a new deflector with an ammunition holder that deflects the used shells downward while passing through one side of the firearm, and ii) includes a substantial part of the bag moved from the left side of the weapon to the right, until the overall mass of the bag balances the weapon.

In document US20100319521, a link chute ejection adapter for discharging a weapon comprises an ammunition strip having a base and a cover positioned above the base. A first side wall is coupled to the base and the cover and comprises a proximal end configured to be received removably in a receiving chamber of the weapon. A second side wall is positioned relative to the first side wall and is coupled to the base and the cover. A link chute coupler is supported at the distal end of the base. An ejection chamber is defined by the base and the cover, the first side wall and the second side wall. The ejection chamber extends in an axial direction globally along a longitudinal axis from a proximal end to a distal end, the proximal end being coupled to the receiving chamber of the weapon and the distal end being connected to an ejection chute. A stop of the housing is supported by the proximal end of the first side wall to position a housing for the ammunition strip. An ammunition stop is supported by the proximal end of the second side wall to position ammunition of the ammunition strip. The ammunition stop axially includes a finger moving outwardly away from the ejection chamber and transversely away from the outside from an outer surface of the second side wall.

As described in document FR 804,422, some machine guns used on board airplanes include two side orifices placed behind one another: an ejection orifice for the shells of the ammunition and a separate orifice for the connectors that were connecting these shells when they entered the slide to exit. To avoid the risks due to violent bursting of the shells, an ejection corridor is fairly frequently adapted to machine guns intended to collect the shells and connectors to prevent them from causing damage to their surroundings. The drawback of this ejection corridor is related to the fact that the shells and connectors are mixed therein and frequently become tangled, which causes swelling and even scratching of the machine-gun if a shell bounces into the shell box. Furthermore, this ejection corridor, which rigidly follows the machine gun in all of its shooting positions and during its vertical travel, can only ensure the flow of the shells and connectors by gravity when it is not too close to the vertical direction, since otherwise swelling occurs due to a lack of flow. The evacuation device proposed in this document was designed to avoid these drawbacks. This makes it possible to obtain the following advantages:

i) selective evacuation of the shells and connectors at their outlet from the machine gun with no possibility of mixing, tangling and swelling;

ii) guiding of the shells and connectors by separate chutes only coming together in a location where mixing of the shells and connectors no longer presents any danger;

iii) capturing shells when they leave the machine gun and deflecting the latter by using the live force due to their ejection, so as to impose, using a carefully placed impact wall, a constant evacuation trajectory with no possibility of bouncing toward the slide box and scratching the machine gun;

iv) automatic angular adaptation of separate chutes to the gravitational flow needs of the shells and connectors by pivoting compensating the travel of the machine gun.

Document U.S. Pat. No. 4,601,230 A discloses a weapon system comprising a primary barrel using a supply of ammunition with connectors and a coaxial machine-gun, both mounted in a turret able to be positioned rotating in an armored vehicle. The ammunition connectors fired by the primary barrel and the ammunition connectors and shells fired by the machine gun are ejected through the neck bearing on which the rotor of the primary weapon rotates, in a compartment that communicates with the outside of the vehicle. The ammunition with connectors of the primary barrel is stored in a rectangular ammunition box positioned diametrically in the turret basket. The connector ejection chutes for the primary barrel comprise guide strips to guide the tabs of the connectors through the chute channels and thus prevent jamming of the chute.

SUMMARY

In an embodiment, the present invention provides a device for ejecting shells and/or connectors from at least one chain or strip of ammunition associated with a primary and/or secondary weapon, the device being mounted in an armored vehicle turret and comprising: a plurality of geometrically and mechanically defined structural elements, configured, after shooting the ammunition, to guide a movement of the shells and/or connectors from an inside toward an outside of the turret, along a determined path; and a vibration device configured to vibrate at least part of the structural elements to favor the movement of the shells and/or connectors, wherein the structural elements include at least one chute, and wherein the vibration device comprises a motor placed in any location of the chute, the motor comprising an unbalancing mass, the motor being configured to be actuated only during shooting.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
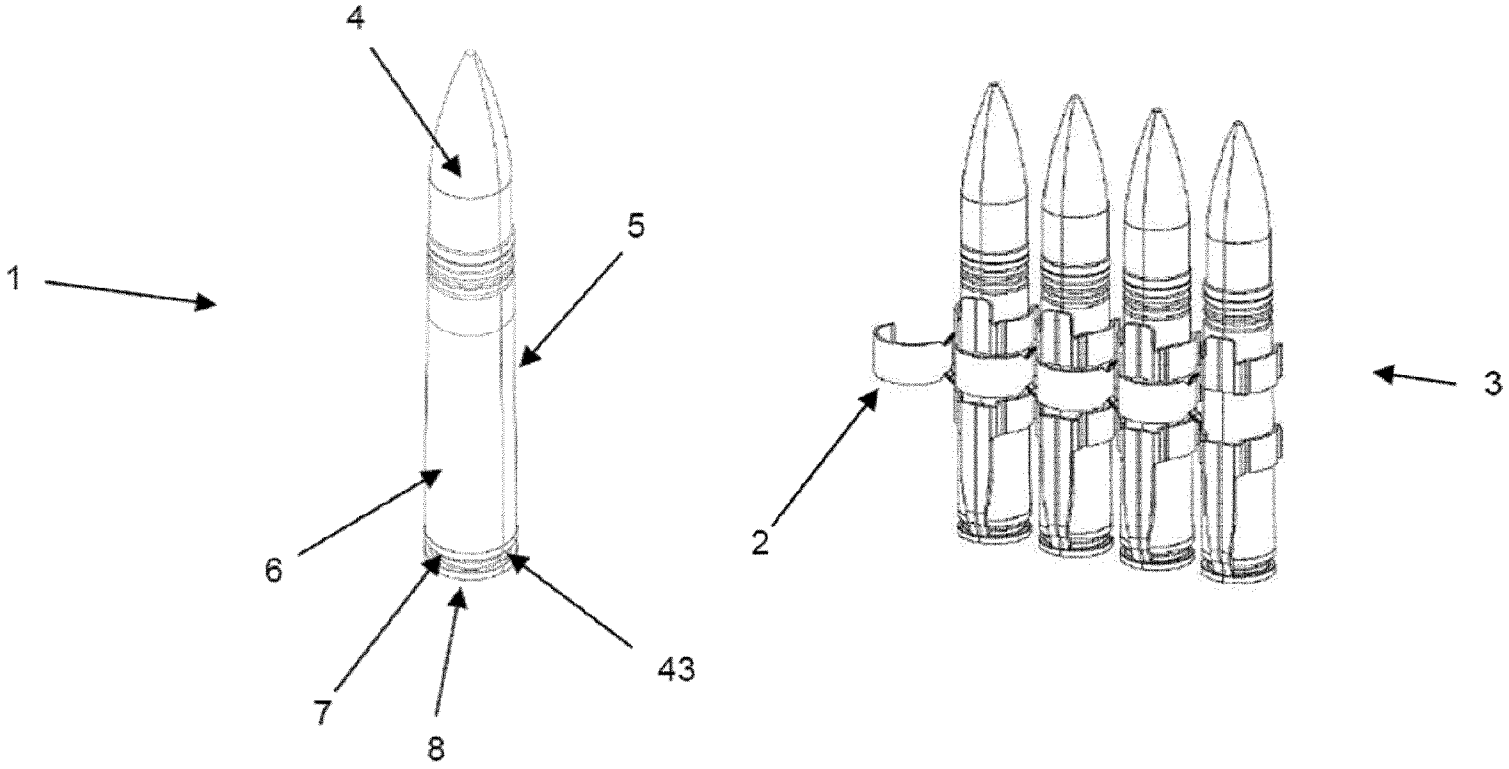
FIG. 1 shows ammunition of the cartridge type, as well as a small- and/or medium-caliber ammunition chain or strip with connectors.

In view of the problems mentioned in the state of the art, in an embodiment of the present invention the inventors focused on establishing a standard and unique architecture in the mask of the turret, this architecture not significantly altering the existing environment, both geometrically and functionally.

In an embodiment, the present invention provides a device taking advantage of and adapting to the existing elements, such as the supply channel(s), the ejection channel(s), etc., situated in the mask area of the turret such that the occupants of the turret, i.e., the commander and the shooter, are located at all times in an environment similar to that previously defined, functionally and ergonomically, with respect to the other modules situated inside the turret (HMI system, handling of the controls, etc.), while guaranteeing greater safety and a more adequate, comfortable living space accessible to the occupants. In other words, one aim sought by the present invention is for the environment not to change regarding the number, arrangement and size of the elements previously present, but to be better optimized functionally and in terms of safety.

Thus, inside the body structure, and consequently that of the turret, there is no substantial modification (geometry, size, location, etc.), since the device to be developed according to the present invention is defined as being in addition to an unchanged architecture, which means that the basic working area for the crewmembers remains identical in each turret, on which the medium-caliber barrel is fastened, defined between 20 mm and 50 mm, and/or the small-caliber coax, situated between 5.56 mm and 15 mm, given that the layout of the interior modules respects a same philosophy.

In the present invention, the device for ejecting shells and/or connectors of a small- and/or medium-caliber ammunition chain or strip is located at the housing of the mask of the turret in the area of the rolling bearings, and more particularly at the outlet, at the mask, of both i) the ejection channel(s) relative to the primary weapon, and ii) the evacuation channel(s) directly connected to the secondary weapon. In other words, considering the main axis of the primary weapon as a reference, the ejection system is located opposite the supply system of the medium-caliber ammunition chain or strip, i.e., the two systems, supply and ejection, are symmetrical relative to the main axis of the primary weapon. The ejection device has also been able to be placed in this location owing to the fact that the body structure has a specific end related to the support plate for the barrel (near the mask) such that the outside layouts of the latter hardly require any modifications in terms of general configuration.

After shooting, in the case of the barrel, the connectors of the medium-caliber ammunition chain or strip can be conveyed through one (or two) ejection channel(s), namely an upper channel and/or a lower channel, based on the type of medium-caliber ammunition to switch in the ejection device, whereas for the secondary weapon, either the shells and the connectors of the small-caliber ammunition chain or strip pass through a single evacuation channel, or said shells (or said connectors) hurtle into the lower evacuation channel and said connectors (or said shells) into the upper channel 2, in fine, plummet into the ejection device as well.

Lastly, from a practical and functional perspective, it should be noted that in certain scenarios, the basket is not integrated into the body structure of the turret. It is thus completely missing from this enclosure, given that the manipulations related to the operation of the turret are done directly from the inside of the armored vehicle itself by a crew member. As a result, the commander and the shooter are not installed at the basket, but inside the vehicle, while the ejection system remains placed in the same location. In other words, the positioning and operation of the ejection system are independent of the number of people present inside the turret.

A first aspect of the present invention relates to a device for ejecting shells and/or connectors from at least one (or combination of) chain(s) or strip(s) of ammunition associated with a primary and/or secondary weapon, the ejection device being mounted in an armored vehicle turret and including a plurality of geometrically and mechanically defined structural elements, making it possible, after shooting ammunition, to guide the movement of the shells and/or connectors from the inside toward the outside of said turret, along a determined path, and including a vibrating device for vibrating at least part of these structural elements to favor said movement of the shells and/or connectors, characterized in that said structural elements include at least one chute, said vibrating device comprising a motor placed in any location of the chute, provided with an unbalancing mass and intended to be actuated only during shooting.

The device according to the invention further comprises at least one of the following features, or any suitable combination thereof:

- the turret includes a body structure with a mask and a housing, and in that the primary weapon is a medium-caliber barrel, called barrel, and the secondary weapon is a small-caliber machine gun, called coax;
- the ammunition intended for the barrel is medium-caliber ammunition, said medium caliber being comprised between 20 mm and 50 mm, while the ammunition associated with the coax is a small-caliber ammunition, said small caliber being comprised between 5.56 and 15 mm;
- on the one hand, attached to the primary weapon is (are) an upper ejection channel and/or a lower ejection channel in which the connectors of a chain or strip of medium-caliber ammunition enter after shooting and continue their route, from the inside toward the outside of the turret, while being separated from one another, such that a connector n progresses only under the impulse of a central loop of the connector n+1, such that, in the case of a single ejection channel, the connectors progress in the latter independently of the orientation of their convex curvature, while in the case of two ejection channels, the connectors that have their convex curve upward circulate in the upper ejection channel and the connectors that have their convex curve downward progress in the lower ejection channel, and on the other hand, attached to the secondary weapon is (are) an upper evacuation channel and/or a lower evacuation channel, either in which the connectors and the shells of a small-caliber ammunition chain or strip enter after shooting and continue their route, from the inside toward the outside of the turret, while being separated from one another, or in which the connectors (the shells, respectively) and the shells (the connectors, respectively) of a chain or strip of small-caliber ammunition respectively enter after shooting and continue a progression similar to that described in the case of a single evacuation channel;

the structural elements making up said ejection device further comprise a surface continuity, a bent channel, a spring device, and a(n) (un)locking housing;

the shell and/or connector ejection device is such that:

the surface continuity is located directly at the outlet of the ejection channel while being secured to a movable closing sheet associated with the mask in order to ensure the continuity between the ejection channel and the following element of the ejection device, namely a bent channel;

the bent channel, characterized by a curve angle of 90°, is the extension of the surface continuity and has two orifices, a first orifice situated at the height of the ejection channel and serving as an intermediary between the surface continuity and the rest of the bent channel, and a second orifice, located after the bend angle of 90°, and in a plane perpendicular to said ejection channel(s), if applicable upper and lower, i.e., pointing toward the ground when the main axis of the barrel is horizontal and when the vehicle is parked or moving on an essentially flat surface;

the chute, fastened on the housing of the body structure of the turret via vibrating studs, assumes the form of a funnel situated either at the outlet of the ejection channel, or respectively at the outlet of an upper ejection channel, via the surface continuity and the bent channel, respectively, and also at the outlet of the lower ejection channel, as well as at the outlet of the respective evacuation channel(s), if applicable upper and lower, said chute also having two orifices, a first orifice making it possible to receive the second orifice of the bent channel such that the penetration of the latter is done over a depth of several centimeters, and a second orifice oriented toward the outside of the turret with an angular deflection relative to the housing of the body structure of the turret, i.e., the chute is not entirely located in the same plane as that containing the bent channel;

the spring device is located below a base sheet of the bent channel, and is controlled by a(n) (un)locking housing situated on an inner part of the housing of the body structure.

the ejection device has a mechanism designed such that it works similarly under all circumstances, i.e., the mechanism is independent of the type and caliber of the ammunition as well as the type of connectors;

the ejection device includes an actuating device for actuating the motor, favoring the vibrations related to the ejection of the shells and/or connectors of an ammunition chain or strip, when the vehicle, and consequently the turret, are not situated on perfectly horizontal ground. Indeed, irrespective of the incline of the vehicle, and consequently of the turret, relative to the earth's absolute horizontal, it is essential for the angle formed between the chute and this horizontal to be favorable to the natural sliding of the connectors toward the outside of the turret. In other words, this corresponds to a strictly positive slope comprised between 1° and 90°;

the chute satisfies the NBC constraint following the presence of two closing devices, a first device in the form of a removable stopper placed at the second orifice of the chute, and a second device in the form of a rubber strip, called bellows seal, permanently fastened to two specific locations, namely one end of the bellows seal completely surrounds the chute while being placed and glued in a slot midway along the height of the latter, and another end of the bellows seal is captured by the closing sheet;

the surface continuity is mounted fixed or sliding longitudinally via a spring device, and a(n) (un)locking housing, in order to favor maintenance operations by members of the crew inside the turret.

A second aspect of the present invention relates to the use of the device for ejecting shells and/or connectors as described above, characterized in that, in the case of the primary weapon, after shooting, in the presence of a single ejection channel, the connectors of a medium-caliber ammunition chain or strip ejected into the latter penetrate the surface continuity, in the first orifice of the bent channel, in order, once the curve angle of 90° is crossed, to orient themselves naturally downward such that they become subject to the effect of gravity, which favors their natural separation from one another at a speed defined by the primary weapon, and lastly progress into the second orifice of the bent channel to plunge one by one into the chute in order ultimately to be ejected outside the turret, whereas in the presence of two ejection channels, the connectors of a medium-caliber ammunition chain or strip are ejected both into the upper ejection channel, to follow the same path as that described above in the presence of a single ejection channel, and into the lower ejection channel, similarly to the manner described for the upper ejection channel, but without passing through any intermediate part at the lower ejection channel, i.e., once the latter has been traveled through, the connectors plunge directly and naturally into the chute in order to be expelled outside the turret according to a separating mode identical or similar to that described for the connectors traversing the upper ejection channel.

Advantageously, in the case of the secondary weapon, after shooting, the connectors and the shells of a small-caliber ammunition chain or strip are ejected simultaneously through the evacuation channel, either separately after they respectively pass in the upper, lower evacuation channels, respectively, and lower, upper evacuation channels, respectively, before plunging, naturally under the effect of gravity, into the chute, and to be expelled outside the turret.

Still advantageously, the motor assists or improves the process of ejecting the shells and/or connectors of an ammunition chain or strip, given that said ejection is not always allowed owing only to the effect of gravity, and given that, when they are channeled in the chute, the shells and/or connectors are slowed slightly in the fall after the various friction existing between them, the resistance between them and the chute, and the incline of the turret, said motor, actuated only during shooting, causing a vibration of the chute, this vibration being characterized by a certain intensity, which makes it possible to eject all of the shells and/or connectors by minimizing the mechanical stresses, said intensity initially being variable given that it depends on the type and caliber of ammunition as well as the type of connectors used, then becoming constant during shooting when a frequency favorable to the ejection of the shells and/or connectors outside the turret has been obtained, said vibration intensity being damped at the turret by the vibrating studs.

In general, the items of ammunition 1 are connected and clipped to one another using connectors 2 in order to form a flexible chain or strip 3 of ammunition 1 (FIG. 1). As a reminder, in terms of its composition, the ammunition 1 is generally made up of a bullet or warhead 4, a shell 5, gunpowder 6, a cup 7, and a fuse 8. In the present case, this involves taking into consideration ammunition 1 with two types of caliber, namely medium-caliber ammunition 1 ranging from 20 mm to 50 mm, and small-caliber ammunition 1, defined between 5.56 mm and 15 mm.

A chain or strip 3 of ammunition 1 has an undefined and unspecified initial size, which means that it is important to keep in mind that, depending on the needs defined by the mission in progress, it is possible to modify the length of said chain or strip 3 of ammunition 1 at any time, either by adding ammunition 1, or removing it. However, for good use of the chain or strip 3 of ammunition 1, the latter must respect a fixed starting length, whereas, depending on the bulk constraints encountered within the turret 9, it may not exceed a certain length. These two parameters must be taken into consideration throughout the entire mission in order to optimize the efficiency of the conveyance of the chain or strip 3 of ammunition 1 to the selected weapon. In other words, between these two minimum and maximum values, as described above, the variation of the size of the chain or strip 3 of ammunition 1 is tolerated inside a turret 9 mounted on any armored vehicle (FIG. 2).

Figure 2:
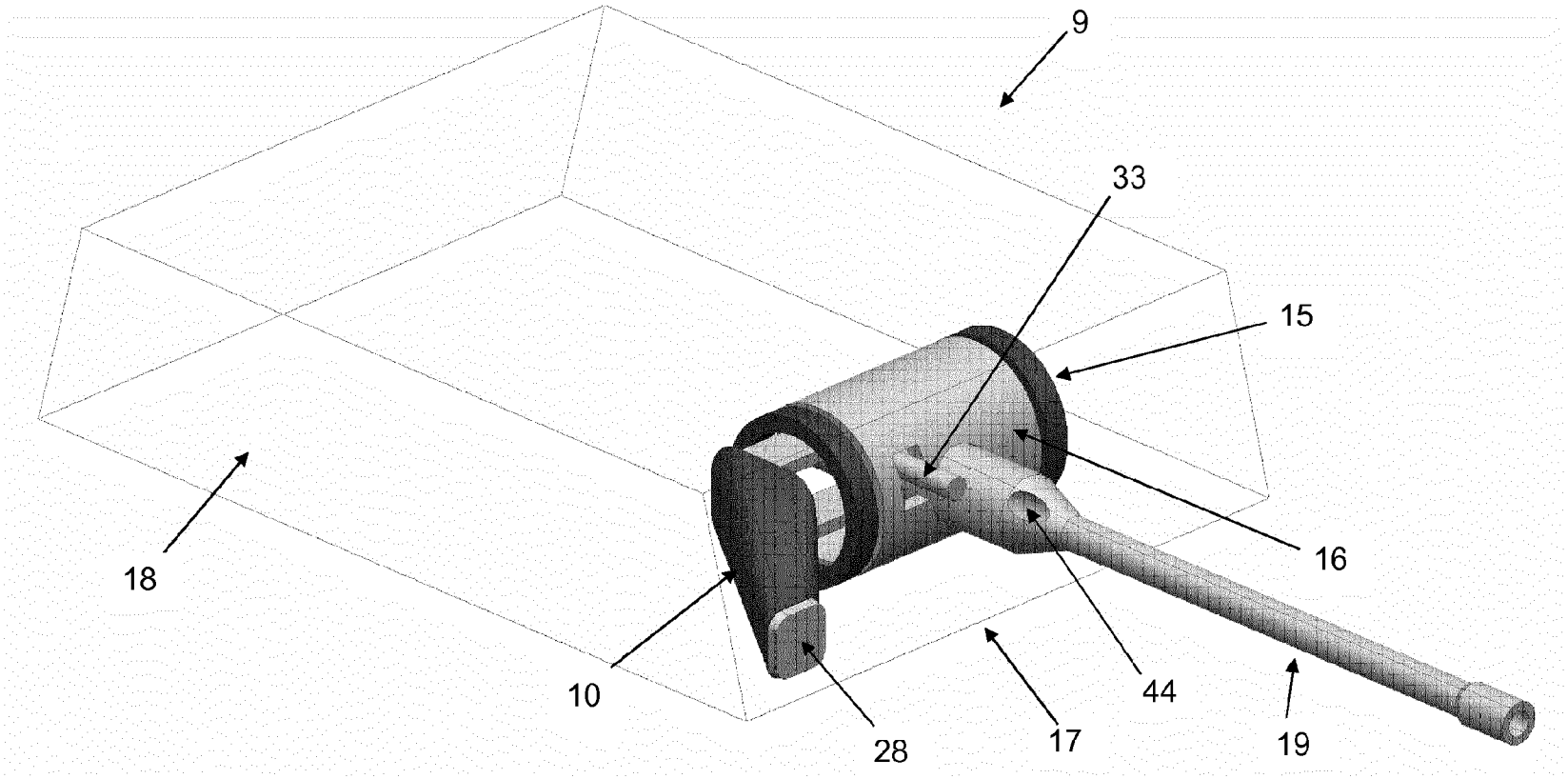
FIG. 2 shows a view of an armored vehicle turret with a primary weapon (barrel), a secondary weapon (machine-gun or coax), and the ejection device.
Figure 3:
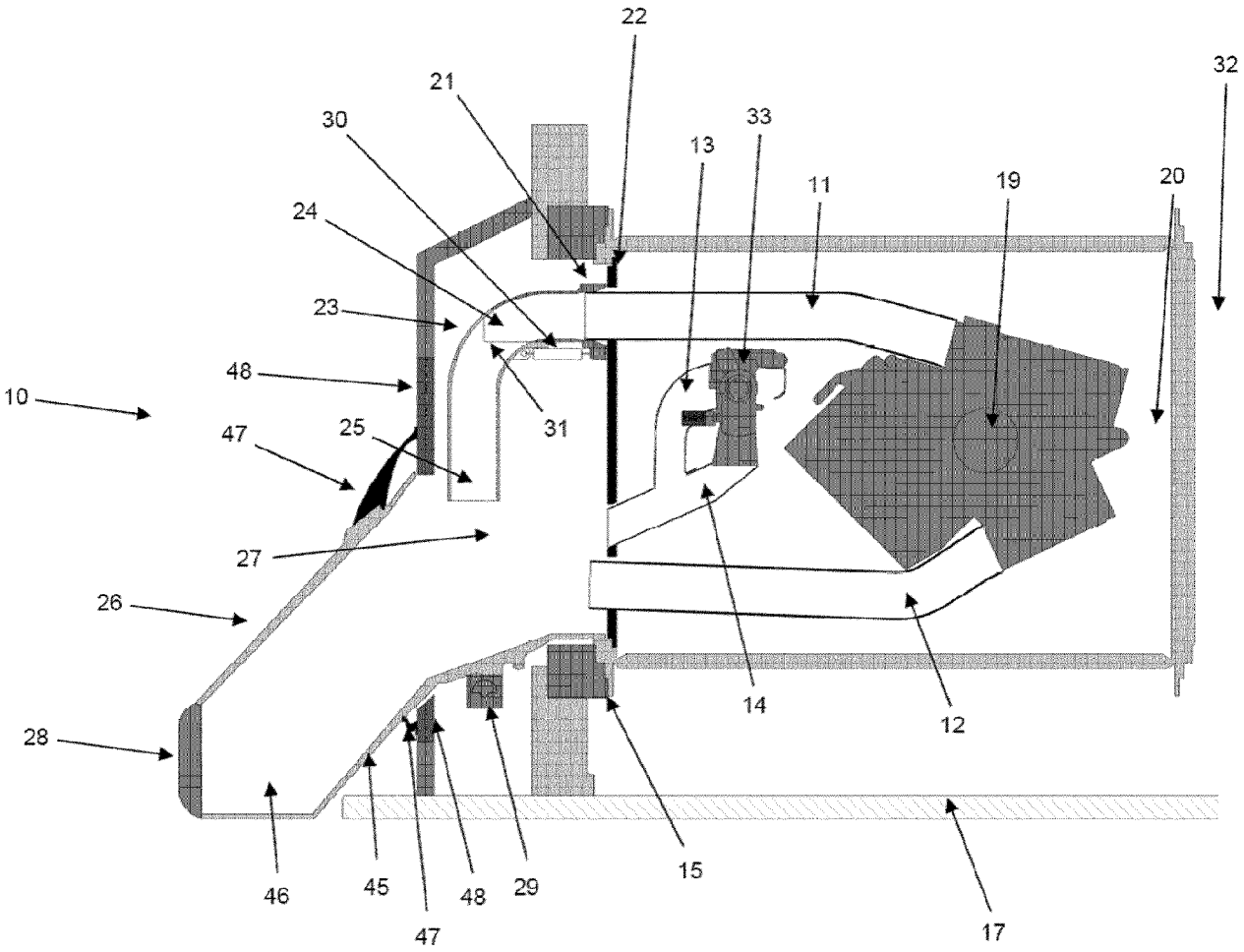
FIG. 3 shows a cross-sectional view relative to the barrel of one preferred embodiment for a device for ejecting shells and/or connectors of a small- and/or medium-caliber ammunition chain or strip according to the present invention.

As shown by FIGS. 2 and 3, the ejection device 10 according to the invention is situated at the outlet of the ejection channels, upper 11 and lower 12, respectively, and evacuation channels, upper 13 and lower 14, respectively, in the region of the rolling bearings 15 near the mask 16, while being fastened on the frame 17 of the body structure 18 of the turret 9. Thus, considering the main axis of the primary weapon, i.e., the barrel 19, as reference, the ejection device 10 is located opposite the supply system 20 of the chain or strip 3 of medium-caliber ammunition 1, transversely relative to the reference axis, which also causes both the supply 20 and ejection 11, 12 systems to be approximately symmetrical relative to said reference.

From a structural perspective (FIG. 3), the ejection device 10 according to the invention comprises a plurality of rigid elements defined as follows:

- a surface continuity 21 is located directly at the outlet of the upper ejection channel 11 while being secured to the movable closing sheet 22 associated with the mask 16 in order to ensure the continuity between this upper channel 11 and the following element of the ejection device 10 (namely the bent channel 23);
- the bent channel 23, having a curve angle of 90°, is the extension of the surface continuity 21, and has two specific orifices: the first orifice 24, situated at the height of the upper ejection channel 11, serves as an intermediary or junction between the surface continuity 21 and the rest of the bent channel 23, while the second orifice 25, located after the bend angle of 90°, is located in a plane perpendicular to said upper 11 and lower 12 ejection channel(s). In other words, it points toward the ground when i) the main axis of the barrel 19 is horizontal, and ii) the vehicle is parked or moving on perfectly flat terrain. The second orifice 25 of said bent channel 23 emerges in a chute 26. The latter is fastened on the housing 17 of the body structure 18 of the turret 9 using vibrating studs, and assumes the form of a funnel situated at the outlet of the respective upper 11 discharge channel, via the surface continuity 21 and the bent channel 23, and lower discharge channel 12, as well as the upper 13 and lower 14 evacuation channels. Said chute 26 also has two orifices: a first orifice 27 makes it possible to receive the second orifice 25 of the bent channel 23 such that the penetration or nesting is done over a depth of several centimeters, while a second orifice 28 is oriented toward the outside of the turret 9. Lastly, the chute 26 is characterized in that it has, at the second orifice 28, an angular deflection relative to the housing 17 of the body structure 18 of the turret 9. In other words, the chute 26 is not completely located in the same plane as that containing the bent channel 23;
- a motor 29, with a smaller size, is placed in any location at said chute 26, and is provided with an unbalancing mass causing a series of vibrations of variable intensity (the operation will be outlined below);
- to take full advantage of the surface continuity 21, a spring device 30 is located below a base sheet 31 of the bent channel 23, and is controlled by a(n) (un)locking housing 32, in turn situated on an inner part of the housing 17 of the body structure 18 of the turret 9 (the operation will be outlined below).

From a functional perspective, the ammunition 1 comes from a chain or strip 3 of medium-caliber ammunition 1 defined between 20 mm and 50 mm intended for the primary weapon 19, as well as a chain or strip 3 of small-caliber ammunition 1 ranging from 5.56 mm to 15 mm reserved for the secondary weapon 33. Another important criterion characterizing the ammunition 1 is that related to the type of ammunition 1, i.e., that defined by its composition/nature. These include "maximum ordinates", "explosives", etc. In the present invention, the ejection device 10 is thus valid for all types of ammunition 1. Lastly, as described above, the items of ammunition 1 are connected and clipped to one another using connectors 2. In general, the latter generally have i) an identical or similar three-dimensional structure, irrespective of the considered type of ammunition 1, and ii) a substantially similar attaching principle independent of the considered type of ammunition 1. Based on the set of criteria set out above, the ejection device 10 according to the present invention has been designed such that it works similarly under all circumstances, in other words the mechanism is independent of the type and caliber of the ammunition 1, as well as the type of connectors 2.

Thus, the ejection relates to i) the connectors 2 of a chain or strip 3 of medium-caliber ammunition 1 only for the barrel 19 and/or ii) the shells 5 and the connectors 2 of a chain or strip 3 of small-caliber ammunition 1 for the coax 33. In both scenarios, the residues must be found outside the turret 9, like the shells 5 associated with the chain or strip 3 of medium-caliber ammunition 1 relative to the primary weapon 19.

Figure 4:
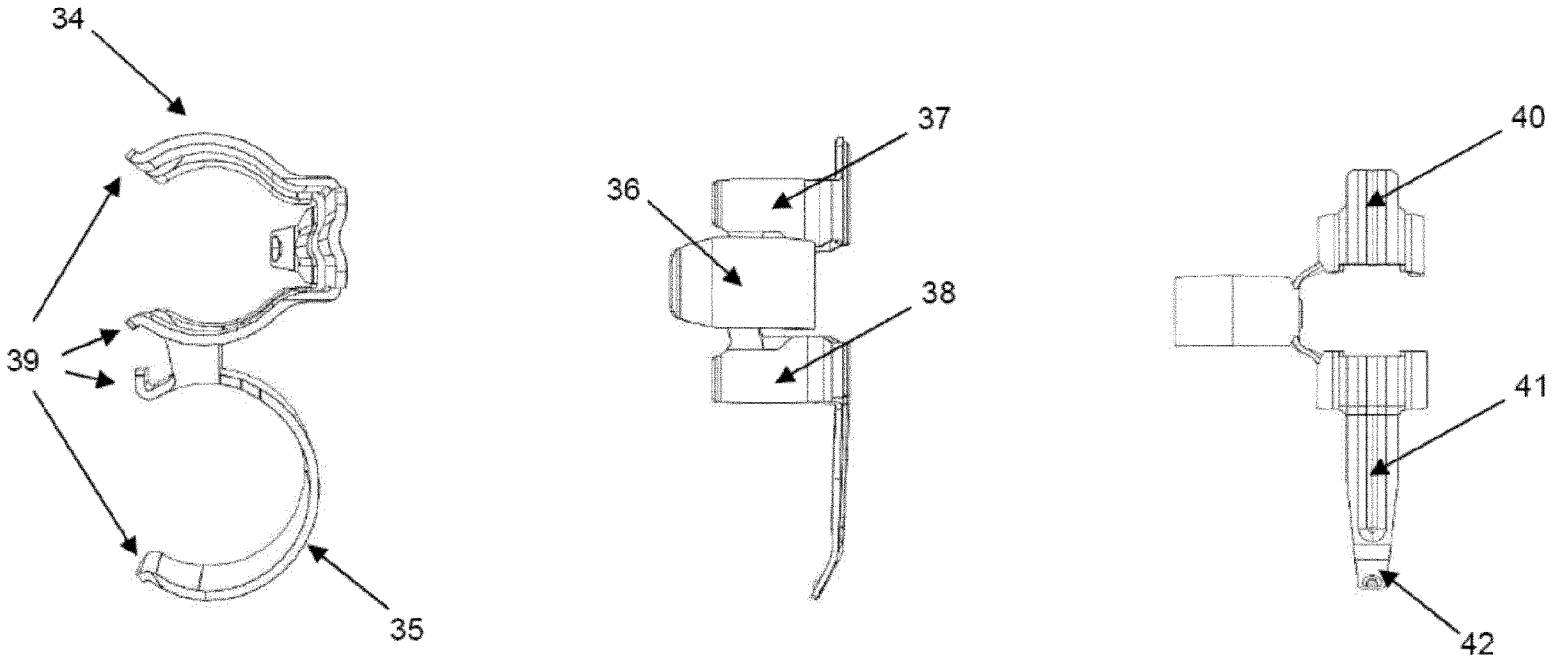
FIG. 4 shows several views of a connector for an ammunition chain or strip used in the present invention.

In one preferred embodiment of the invention, the caliber of the ammunition 1 is 30 mm and/or 40 mm for the primary weapon 19, and 7.62 mm for the secondary weapon 33, while the type of connector 2 is or is similar to that described in FIG. 4. The connector 2 is made up of a two parts 34, 35, generally articulated to one another. The second part 35 includes a central loop or curl 36, relative to the height of the connector 2, defining an approximately semi-cylindrical opening, dimensioned to be adjusted on the shell 5 of a cartridge 1 with a given caliber. The first part 34 includes two loops 37, 38 of this type, but situated, in terms of height, respectively on either side of the central loop 36. Each of these loops 36, 37, 38 includes, at its each of its two free ends, a small loop 39 oriented in the other direction, so as to define a flare allowing easy insertion or withdrawal of the ammunition 1. The upper loop 37 of the first part 34 is extended by an essentially flat and rectangular part 40 extending upward, and the lower loop 38 of the first part 34 is extended downward by an essentially flat part 41, ending with a finger 42 that is inserted in the removal slot 43 of the shell 5 in order to guarantee the correct alignment of the ammunition 1 in the chain or strip 3 of ammunition 1. The flexibility of the chain or strip 3 of ammunition 1 is due to the articulation between the loop or curl 36 and the ammunition 1.

However, it should be noted that the ejection device 10 according to the present invention does not apply to the ejection of shells 5 for ammunition 1 belonging to the chain or strip 3 of medium-caliber ammunition 1. Indeed, in this case, said shells 5 are ejected through an orifice 44 situated at the mask 16 of the turret 9, near the primary weapon 19. The ejection is done in the forward direction outside the turret 9, in a direction "practically" parallel to the axis of the barrel 19.

To understand the operating mode of the ejection device 10 according to the present invention, it is necessary to analyze each of the components set out above.

Before examining such considerations, it should be recalled that initially, i.e., before shooting, within the turret 9, the chain or strip 3 of medium- and/or small-caliber ammunition 1 is conveyed toward the primary 19 or secondary 33 weapon, respectively, following specific supply channels 20. After shooting, the bullet 4 is expelled outside the selected weapon 19, 33, but it must be taken into consideration that the ammunition 1 residues must also be ejected using specific ejection and/or evacuation channels.

Thus, in the case of the primary weapon 19, when the chain or strip 3 of medium-caliber ammunition 1 reaches the height of the latter primary weapon 19, after having left the supply system 20, and once the shooting is done, the connectors 2 continue their route by entering the ejection channels 11, 12. More specifically, depending on the selected type of medium-caliber ammunition 1, the connectors 2 enter either the upper ejection channel 11, or the lower ejection channel 12. In both cases, the connectors 2 advance alone, given that the ammunition 1 has been removed from the chain or strip 3 of ammunition 1. At this time, the connectors 2 are separated from one another such that the connector n progresses only under the impulse of the central loop 36 of the connector n+1.

With respect to the upper ejection channel 11, the connectors 2 have their convex curve upward therein. The path continues such that they first penetrate the surface continuity 21 (the operating principle related to its mobility will be explained below), then the first orifice 24 of the bent channel 23 using a connecting mode similar to that described above with the ejection channels 11, 12. Once the curve angle of 90° is crossed, the connectors 2 naturally orient themselves downward such that they are subject to the effect of gravity. Under the action of the latter, the connectors 2 naturally separate from one another at a speed defined by the operation of the primary weapon 19. When the second orifice 25 of the bent channel 23 is traversed, the individualized connectors 2 dive toward the chute 26, ultimately to be ejected outside the turret 9.

For the lower ejection channel 12, the approach is substantially similar to that described for the upper ejection channel 11. The differences essentially appear in the following steps: i) the connectors 2 have their convex curve downward therein, and ii) the residues do not pass through intermediate parts (such as the surface continuity 21 and/or the bent channel 23 in the case of the upper ejection channel 11) at the outlet of the lower ejection channel 12. In other words, once the latter channel 12 has been traveled, the residues dive directly and naturally into the chute 26 in order to be expelled outside the turret 9 according to a separating mode identical to that defined for the connectors 2 traversing the upper ejection channel 11.

In the case of the secondary weapon 33, once the chain or strip 3 of small-caliber ammunition 1 reaches the height of the secondary weapon 33, also after having passed through the supply channels 20, once the shooting is done, the shells 5 and the connectors 2 will be ejected separately after they pass in two specific and separate evacuation channels 13, 14: i) for the connectors 2, they follow the upper evacuation channel 13 before diving, naturally under the effect of gravity, into the chute 26 to end up outside the turret 9, and ii) for the shells 5, the ejection mechanism is substantially similar, with the difference that the shells 5 follow the lower ejection channel 14 to end up outside the turret 9 after having been collected in the chute 26.

Thus, both for the residues from the primary weapon 19 and those from the secondary weapon 33, the chute 26 serves as a funnel to channel them so that they may be ejected outside the turret 9.

It should also be noted that in both scenarios, i.e., for the residues indifferently coming from each type of weapon 19 and/or 33, the ejection outside the turret 9 is not always done only by gravity. Indeed, when they are channeled into the chute 26, the residues are slowed slightly in their fall following i) various friction existing between them, ii) the resistance between them and the chute 26, and iii) the incline of the turret 9. This is why preferably, a small motor 29 is placed in any location at said chute 26. The purpose of this motor 29 is to cause, via an unbalancing mass, a vibration with a certain intensity, which makes it possible to eject all of the residues by minimizing the mechanical stresses. Its intensity is initially variable, given that it depends on the type and caliber of the ammunition 1 as well as the type of connectors 2 used. This intensity should next be constant during shooting when an adequate frequency favorable to the ejection of the residues outside the turret 9 has been obtained. The vibration is absorbed by the vibrating studs, fastening the chute 26 to the housing 17 of the body structure 18 of the turret 9, and its frequency can be modified easily by changing the unbalancing mass. This motor 29 is actuated only during shooting. Indeed, upstream, the first item of ammunition 1 is rearmed to be brought in front of the orifice of the considered weapon 19, 33. Next, when shooting is initiated, the bullet 5 is fired such that i) the gases resulting from this maneuver are recovered by fans to be ejected outside the turret 9, and ii) the motor 29 is actuated simultaneously. It should be noted that, in one preferred embodiment of the invention, the motor 29 is situated below the base sheet 45 of the chute 26.

The presence of the motor 29 is even more useful and justified when the vehicle, and consequently the turret 9, are not situated on perfectly horizontal ground. Thus, when the vehicle is stopped or moving on uneven terrain, the turret 9 cannot undergo an incline exceeding a certain value. Yet, since the chute 26 itself has a specific angular deflection relative to the housing 17 of the body structure 18 of the turret 9, the maximum angular difference in absolute value is comprised between 1° and 90°. If this value is too low to favor the ejection of residues under the effect of gravity, only the motor 29 acts to drive and accelerate the fall thereof.

One additional criterion associated with the chute 26 is related to the NBC constraint, i.e., relative to the nuclear, biological and/or chemical protection(s) associated with the considered weapon 19, 33. To satisfy the latter, two closing devices are considered simultaneously:

- a removable stopper 46 is placed at the second orifice 28 of the chute 26;
- a rubber strip 47, called bellows seal, is permanently fastened in two specific locations. At one end, it completely surrounds the chute 26 while being placed and glued in a slot midway along the height of the latter 26, and at the other end, it is captured by the closing sheet 48.

The last parameter to be taken into consideration in the ejection device 10 according to the invention is the surface continuity 21. This is a structure which i) provides the connection between the upper ejection channel 11 and the first orifice 24 of the bent channel 23, and ii) remains fixed or slides longitudinally. It is associated with a spring device 30 via a vertical plate adjacent to the bent channel 23, situated below the base sheet 31 of the bent channel 23, the spring device 30 in turn, via said vertical plate, being connected to a(n) (un)locking housing 32 managed by a member of the crew present in the turret 9.

Thus, during operation, the spring device 30 is tensed such that the surface continuity 21 tends to be brought back toward the upper ejection channel 11 to define and ensure continuity between these two structures 11, 21. In other words, it is the (un)locking housing 32 or click that keeps the spring device 30 in this position to prevent the surface continuity 21 from returning. To perform maintenance on certain specific elements within the turret 9, it suffices to free the (un)locking housing 32 or click in order for the spring device 30 no longer to be tensed and the surface continuity 21 to slide outward, in other words, for it no longer to be secured to the upper ejection channel 11. Owing to this separating operation, as a safety measure, the crewmember can remain within the turret 9 in order, for example, to: i) perform maintenance operations of the primary weapon 19, ii) clear incorrectly engaged ammunition 1, iii) remove the supply 20 and/or ejection 11, 12 channel(s), iv) etc.

The project currently being developed makes it possible to achieve very high operational, functional, ergonomic, economic, etc. levels after the positioning defined above.

In terms of the mechanical aspects, the assembly follows from a relatively simple approach, while configuring a rigid fastener able to absorb all of the impacts and vibrations as needed during the various movements of the turret and/or the vehicle in which the turret is attached, these movements being both in terms of elevation and rotation, as well as those described by the movements of the vehicle.

Thus, to favor such mounting, the turret, and more particularly the environment at the interface around the barrel, has undergone only slight structural modifications. The latter essentially appear at a specific end of the body structure of the turret in direct contact with the support plate of the barrel adjoining the mask as well as at the mask as such. This is why this ejection device is mounted on a turret with which a small- and/or medium-caliber barrel is associated. In the case of the large-caliber barrel, the ejection and recovery of the residues of the ammunition follows a completely different approach, which is why it is not developed in this patent application.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SYMBOLS

1 ammunition
2 connector
3 chain or strip
4 bullet or warhead
5 shell
6 gunpowder
7 cap
8 fuse
9 turret
10 ejection device
11 upper ejection channel
12 lower ejection channel
13 upper evacuation channel
14 lower evacuation channel
15 rolling bearing(s)
16 turret mask
17 housing
18 body structure
19 barrel
20 ammunition supply system
21 surface continuity
22 closing sheet
23 bent channel
24 first orifice of the bent tube
25 second orifice of the bent tube
26 chute
27 first chute orifice
28 second chute orifice
29 motor
30 spring device
31 base sheet
32 (un)locking housing
33 machine-gun or coax
34 first connector part
35 second connector part
36 central curl or loop
37 loop
38 loop
39 small opposite loop
40 rectangular part
41 flat part
42 finger
43 removal slot

44 ejection orifice at the mask
45 base sheet
46 chute stopper
47 bellows seal
48 closing sheet

The invention claimed is:

1. A device for ejecting shells and/or connectors from at least one chain or strip of ammunition associated with a primary and/or secondary weapon, the device being mounted in an armored vehicle turret and including comprising:

a plurality of geometrically and mechanically defined structural elements, configured, after shooting the ammunition, to guide a movement of the shells and/or connectors from an inside toward an outside of the turret, along a determined path; and a vibration device configured to vibrate at least part of the structural elements to favor the movement of the shells and/or connectors, wherein the structural elements include at least one chute, and wherein the vibration device comprises a motor placed in any location of the chute, the motor comprising an unbalancing mass, the motor being configured to be actuated only during shooting.

2. The device for ejecting shells and/or connectors according to claim 1, wherein the turret includes a body structure with a mask and a housing, and wherein the primary weapon comprises a medium-caliber barrel, or barrel and the secondary weapon comprises a small-caliber machine gun or coax.

3. The device for ejecting shells and/or connectors according to claim 2, wherein the ammunition for the barrel comprises medium-caliber ammunition, the medium caliber being between 20 mm and 50 mm, while the ammunition associated with the coax comprises a small-caliber ammunition, the small caliber being between 5.56 and 15 mm.

4. The device for ejecting shells and/or connectors according to claim 2, wherein attached to the primary weapon is (are) an upper ejection channel and/or a lower ejection channel in which the connectors of a chain or strip of medium-caliber ammunition enter after shooting and continue their route, from the inside toward the outside of the turret, while being separated from one another, such that a connector n progresses only under an impulse of a central loop of the connector n+1, such that, in a case of a single ejection channel, the connectors progress in the single ejection channel independently of an orientation of their convex curvature, while in the case of two ejection channels, the connectors that have their convex curve upward circulate in the upper ejection channel and the connectors that have their convex curve downward progress in the lower ejection channel, and wherein attached to the secondary weapon is (are) an upper evacuation channel and/or a lower evacuation channel, either in which the connectors and the shells of a small-caliber ammunition chain or strip enter after shooting and continue their route, from the inside toward the outside of the turret, while being separated from one another, or in which the connectors (the shells, respectively) and the shells (the connectors, respectively) of a chain or strip of small-caliber ammunition respectively enter after shooting and continue a progression similar to that described in the case of a single evacuation channel.

5. The device for ejecting shells and/or connectors according to claim 4, wherein the structural elements further comprise a surface continuity, a bent channel, a spring device, and a(n) (un)locking housing.

6. The device for ejecting shells and/or connectors according to claim 5, wherein:

the surface continuity is located directly at an outlet of the upper ejection channel while being secured to a movable closing sheet associated with the mask in order to ensure continuity between the ejection channel and a following element of the ejection device, namely the bent channel;

the bent channel having a curve angle of 90°, is an extension of the surface continuity and has two orifices, a first orifice situated at a height of the ejection channel and serving as an intermediary between the surface continuity and a remainder of the bent channel, and a second orifice, located after the bend angle of 90°, and in a plane perpendicular to the ejection channel(s), if applicable upper and lower, so as to point toward the ground when a main axis of the barrel is horizontal and when the vehicle is parked or moving on an essentially flat surface;

the chute, fastened on the housing of the body structure of the turret via vibrating studs, comprises a funnel situated either at the outlet of the ejection channel, or respectively at the outlet of an upper ejection channel, via the surface continuity and the bent channel, respectively, and also at the outlet of the lower ejection channel, as well as at the outlet of the respective evacuation channel(s), if applicable upper and lower, the chute also having two orifices, a first orifice configured to receive the second orifice of the bent channel such that a penetration of the bent channel is done over a depth of several centimeters, and a second orifice oriented toward the outside of the turret with an angular deflection relative to the housing of the body structure of the turret comprising the chute is not entirely located in a same plane as that containing the bent channel; and the spring device is located below a base sheet of the bent channel, and is controlled by the (un)locking housing situated on an inner part of the housing of the body structure of the turret.

7. The device for ejecting shells and/or connectors according to claim 1, further comprising a mechanism configured such that the device works similarly under all circumstances, in that the mechanism is independent of a type and caliber of the ammunition as well as a type of connectors.

8. The device for ejecting shells and/or connectors according to claim 5, further comprising an actuating device configured to actuate the motor, favoring vibrations related to an ejection of the shells and/or connectors of the chain or strip of ammunition, when the vehicle, and the turret, are not situated on perfectly horizontal ground, such that, irrespective of an incline of the vehicle, and consequently of the turret, relative to the earth's absolute horizontal, an angle formed between the chute and the horizontal is favorable to a natural sliding of the connectors toward the outside of the turret, which corresponds to a strictly positive slope between 1° and 90°.

9. The device for ejecting shells and/or connectors according to claim wherein the chute satisfies an NBC constraint following a presence of two closing devices, a first device comprising a removable stopper placed at the second orifice of the chute, and a second device comprising a rubber strip or bellows seal, permanently fastened to two specific locations, such that one end of the bellows seal completely surrounds the chute while being placed and glued in a slot midway along a height of the chute, and another end of the bellows seal being captured by the closing sheet.

10. The device for ejecting shells and/or connectors according to claim 5, wherein the surface continuity is mounted fixed or sliding longitudinally via a spring device, and the (un)locking housing, to favor maintenance operations inside the turret.

11. A method of using the device for ejecting shells and/or connectors according to claim 5, wherein, in a case of the primary weapon, after shooting, in a presence of a single ejection channel, the connectors of a medium-caliber ammunition chain or strip ejected into the single ejection channel penetrate the surface continuity, in the first orifice of the bent channel, in order, once the curve angle of 90° is crossed, to orient themselves naturally downward such that they become subject to an effect of gravity, which favors their natural separation from one another at a speed defined by the primary weapon, and lastly progress into the second orifice of the bent channel to plunge one by one into the chute in order ultimately to be ejected outside the turret, whereas in a presence of two ejection channels, the connectors of a medium-caliber ammunition chain or strip are ejected both into the upper ejection channel, to follow a same path as that described above in the presence of a single ejection channel, and into the lower ejection channel, similarly to a manner described for the upper ejection channel, but without passing through any intermediate part at the lower ejection channel, such that once the lower ejection channel has been traveled through, the connectors plunge directly and naturally into the chute in order to be expelled outside the turret according to a separating mode identical or similar to that defined for the connectors traversing the upper ejection channel.

12. A method of using the device for ejecting shells and/or connectors according to claim 5, wherein, in a case of the secondary weapon, after shooting, the connectors and the shells of a small-caliber ammunition chain or strip are ejected simultaneously through the evacuation channel, either separately after they respectively pass in the upper and, lower evacuation channels, respectively, and lower and upper evacuation channels, respectively, before plunging, naturally under an effect of gravity, into the chute to be expelled outside the turret.

13. A method of using the device for ejecting shells and/or connectors according to claim, wherein the motor is configured to assist or improve a process of ejecting the shells and/or connectors of an ammunition chain or strip, given that the ejection is not always allowed owing only to the effect of gravity, and given that, when channeled in the chute, the shells and/or connectors are slowed slightly in a fall after the various friction existing between them, a resistance between them and the chute, and an incline of the turret, the motor, being configured to be actuated only during shooting, being configured to cause a vibration of the chute of a certain intensity, enabling ejection of all of the shells and/or connectors by minimizing the mechanical stresses, the intensity initially being variable by depending on a type and caliber of ammunition as well as a type of connectors used, then becoming constant during shooting when a frequency favorable to the ejection of the shells and/or connectors outside the turret has been obtained, the vibration intensity being damped at the turret by the vibrating studs.

* * * * *